United States Patent [19]

Thurner

[11] Patent Number: 4,463,793

[45] Date of Patent: Aug. 7, 1984

[54] VACUUM DIE CASTING MACHINE

[75] Inventor: Hans Thurner, Baldham, Fed. Rep. of Germany

[73] Assignee: Bayerisches Druckguss-Werk Thurner KG, Markt Schwaben, Fed. Rep. of Germany

[21] Appl. No.: 343,961

[22] Filed: Jan. 29, 1982

Related U.S. Application Data

[63] Continuation-in-part of Ser. No. 141,782, Apr. 21, 1980, abandoned.

[30] Foreign Application Priority Data

Jan. 28, 1980 [DE] Fed. Rep. of Germany ..... 3002886

[51] Int. Cl.[3] ..... B22D 17/14; B22D 17/32

[52] U.S. Cl. ..... 164/155; 164/157; 164/305

[58] Field of Search ..... 164/4.1, 61, 65, 154, 164/155, 157, 253, 313, 305, 457

[56] References Cited

U.S. PATENT DOCUMENTS

| | | | |
|---|---|---|---|
| 2,668,985 | 2/1954 | Babbity | 164/65 X |
| 2,785,448 | 3/1957 | Hodler | 164/305 |
| 3,006,043 | 10/1961 | Goldhammer | 164/4.1 |
| 3,019,495 | 2/1962 | Cornell | 164/312 X |
| 3,085,302 | 4/1963 | Federman | 164/253 X |
| 3,172,174 | 3/1965 | Johnson | 164/157 |
| 3,283,372 | 11/1966 | Moorman et al. | 164/157 X |
| 4,239,080 | 12/1980 | Hodler | 164/305 |

FOREIGN PATENT DOCUMENTS

| | | | |
|---|---|---|---|
| 2323426 | 11/1974 | Fed. Rep. of Germany | 164/253 |
| 1416039 | 9/1965 | France | 164/305 |

*Primary Examiner*—Nicholas P. Godici
*Assistant Examiner*—J. Reed Batten, Jr.
*Attorney, Agent, or Firm*—Pearne, Gordon, Sessions, McCoy, Granger & Tilberry

[57] ABSTRACT

A method and apparatus for casting molten metal in a die casting machine having matching die assemblies movable between open and closed positions, a plunger for injecting molten metal into the die cavity, a vacuum system for evacuating the die cavity during injection of molten metal and a vacuum control valve for opening and closing the exhaust passage through which the air is evacuated. A fluid cylinder is mounted on one die assembly with its piston rod coupled to the valve rod of the vacuum control valve. The fluid cylinder has a solenoid-operated control valve actuated by an electric switch operated by movement of the molten metal injection piston so that the vacuum control valve begins to close at a predetermined point during the injection stroke. The injection plunger also actuates a timer at the same time it actuates the solenoid-operated control valve. As the vacuum control valve approaches its closed position, it actuates another switch that initiates the final injection stroke of the injection piston. If the latter switch is not actuated by the time the timer times out, the injection plunger is retracted before injection of molten metal is completed, so that no molten metal can enter the vacuum passages due to incomplete closure of the vacuum valve.

1 Claim, 4 Drawing Figures

VACUUM DIE CASTING MACHINE

BACKGROUND OF THE INVENTION

This is a continuation-in-part of application Ser. No. 141,782, filed Apr. 21, 1980 now abandoned.

This invention relates both to a vacuum die casting machine and to a method of operating the same. More particularly, the invention relates to a vacuum control system that assures that the valve that closes the passage through which atmosphere is evacuated from the mold cavity is closed before molten metal being injected into the cavity can penetrate the evacuation passages.

In vacuum die casting machines with vacuum pumps for evacuating the mold cavities, the final filling of the mold with molten metal occurs within a few milliseconds of the evacuation of the die cavity. To obtain a vacuum as high as possible, the exhaust passage communicating with the die cavity should preferably be closed as late in the process as possible, i.e., shortly before the molten metal can progress into the evacuation passages.

One problem with prior art vacuum systems is that the vacuum valve emplaced in the mold, i.e., in one of the mold sections, must be controlled in response to the injection of the molten metal so that, on the one hand, the valve will remain open as long as possible in order to draw off as much atmosphere as possible, but, on the other hand, the valve can be closed in time so that no molten metal can penetrate the exhaust channels through the vacuum valve. An evacuation as complete as possible is advantageous because a large part of the oil and wax vapors generated in the mold can be evacuated as well.

There are a number of means for controlling the closing of the vacuum valve. In one system, a membrane located in the mold senses the injection of molten metal into the mold cavity and actuates an electrical switch that opens a solenoid valve. The solenoid valve connects a compressed air source to an air cylinder so that the air cylinder closes the vacuum valve at the last possible moment. It is possible to keep the vacuum valve open for a long period of time, since there is a direct relationship between the injection of molten metal and the closing of the valve. The vacuum valve is closed, therefore, entirely in response to the injection of molten metal. The disadvantage of this system is its high cost and its vulnerability to failure. The sensing membrane must be replaced frequently, since it is subject to considerable fatigue and wear. The greater the number of operating components, switches, etc. in such a system, the greater the possibility of failure. The consequence of such failure is that molten metal penetrates the vacuum system. The removal of solidified metal from the evacuation passages that must be done as a result of such failure is extremely costly.

In view of this difficulty, an object of the present invention is to develop a vacuum die casting machine of the type described that has an improved reliability with a minimum of operating components that are easily replaced. In addition, it is important that the evacuation of the mold cavity be as complete as possible. The vacuum die casting machine should, therefore, be constructed so that it can be operated safely and so that the penetration of molten metal into the vacuum channels is prevented.

SUMMARY OF THE INVENTION

The advantages of the present invention are achieved by providing a novel system that is associated with a vacuum die casting machine that includes matching die assemblies relatively movable between open and closed positions and which define a die cavity when in their closed position. The machine has means for injecting molten metal into the cavity and means associated with one of the die assemblies for evacuating atmosphere from the cavity during operation of the molten metal injecting means. A valve in one of the die assemblies moves linearly between open and closed positions to interrupt the evacuation of atmosphere from the cavity at the desired point in the casting cycle.

In accordance with the apparatus of the invention, there is provided a fluid cylinder-operated actuating means removably mounted on one of the die assemblies and having a piston aligned with the valve means and adapted for linear movement. A removably mounted coupling connects the piston with the valve means and an electrically operated means controls the operation of the fluid cylinder. An electrical switch operable by the molten metal injecting means is adapted to actuate the electrical means for controlling the fluid cylinder to initiate the closing movement of the valve means at a desired time during injection of molten metal. Another electrical switch that is operatively associated with the coupling means initiates the final molten metal injection movement of the injecting means when the valve is initially closed. A timing means actuated by the molten metal injecting means initiates a predetermined time interval and a means actuated at the end of the time interval causes retraction of the molten metal injecting means in the event the coupling means does not actuate the second electrical switch during the predetermined time interval.

In accordance with the method of the invention which relates to the operation of the equipment of the type described, the die casting operation comprises the steps of:

(1) closing the die sections;
(2) operating the plunger to force a predetermined charge of molten metal through a supply passage toward the cavity;
(3) generating a first electrical vacuum actuating signal in response to initial travel of the piston;
(4) operating the vacuum means in response to the vacuum actuating signal to evacuate atmosphere from the die cavity;
(5) generating a second electrical signal in response to further travel of the plunger;
(6) simultaneously initiating a timing means in response to the second electrical signal to measure a predetermined time interval;
(7) interrupting the evacuation of atmosphere from the cavity with a valve means in response to the second electrical signal;
(8) generating a third electrical signal in response to closing movement of the valve means;
(9) retracting the plunger in response to expiration of the time interval if the third electrical signal is not generated during the time interval; and
(10) initiating a final, relatively rapid movement of the plunger in response to the third electrical signal to complete the injection stroke.

The vacuum die casting machine of the invention is of a relatively simple design and, due to the use of a universal actuating insert, makes it possible to operate a plurality of vacuum die casting machines by switching the insert from one machine to another to achieve significant savings in costs. A quickly detachable actuating insert adaptable for use on any number of die casting machines contains the essential components for actuating the valve rod of the vacuum valve that controls the connection between the exhaust channel and the mold cavity. The actuating insert, after being mounted on the mold, becomes an integral part of an actuating and control system that achieves an excellent evacuation of the mold cavity without permitting the injection of molten metal into the vacuum system. A limit switch mounted on a build-up plate together with the components that actuate the valve rod are basic parts of the switching arrangement for initiating the final injection thrust of the injection plunger and, in connection with a timing function, cause the final thrust for injecting the molten metal. The final thrust of the injection plunger, however, is not accomplished until the valve rod with its sealing head is completely closed within the vacuum insert.

With one embodiment of the invention, additional exhausting of atmosphere from the die cavity is accomplished by means of the bores that receive the ejector pins. In accordance with this aspect of the invention, the annular space between the injector pins and their respective bores, and the space between the mold insert and the receptacle in which it is mounted are used to evacuate atmosphere through additional evacuation passages that are connected to one another. One advantage of this arrangement is that air cannot penetrate through these spaces into the mold cavity but, rather, are used for the opposite purpose.

Also, liquid coolant, such as a cooling oil, can be drawn off if it penetrates into the aforementioned spaces between the ejector pins and the ejector pin bores or between the mold insert and its machined seat due to leakage.

DESCRIPTION OF THE PREFERRED EMBODIMENT

Figure 1:
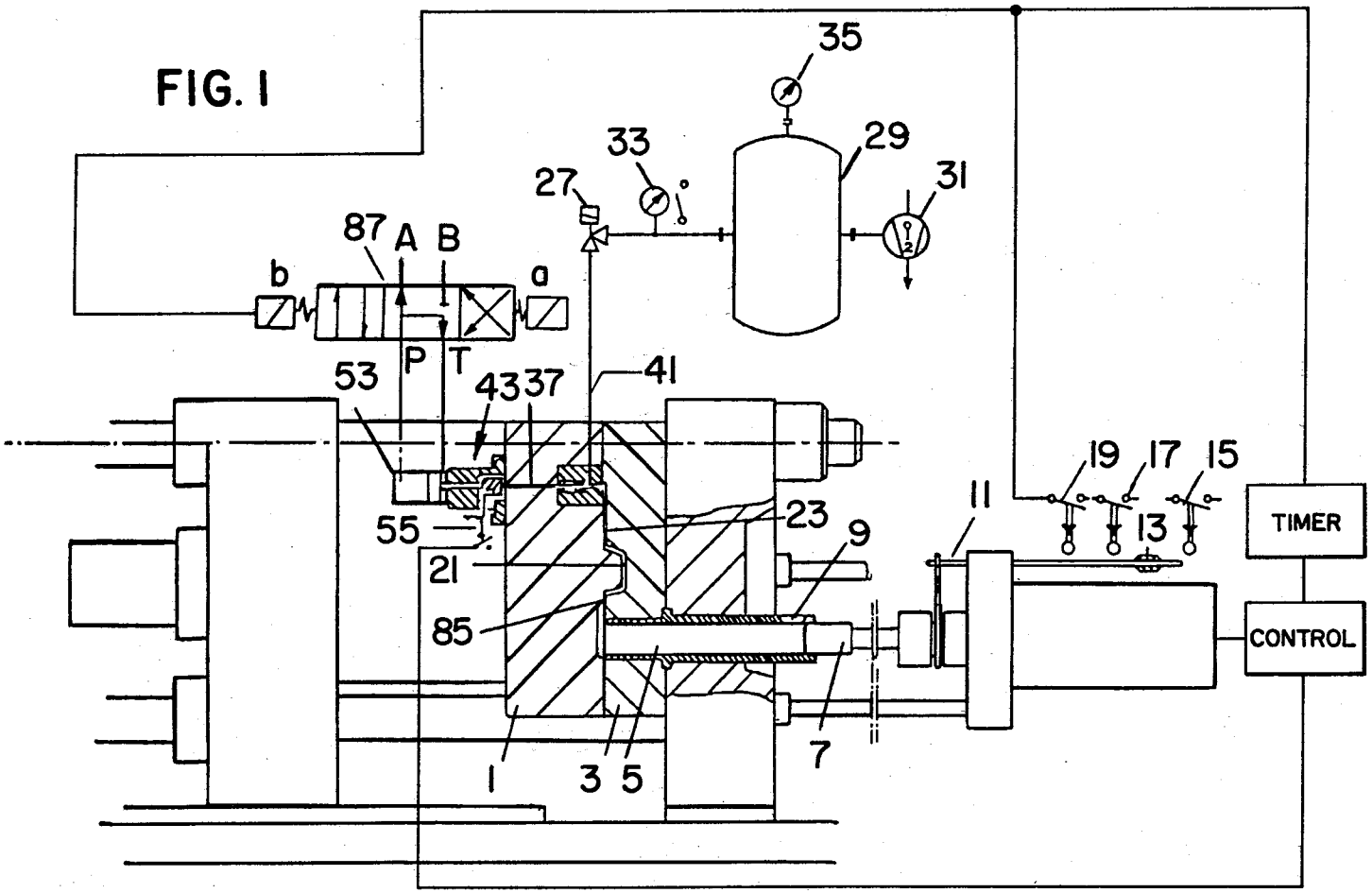
FIG. 1 is a diagrammatic view, partly in section, illustrating a vacuum die casting machine in which the replaceable actuating insert is schematically represented.

The vacuum die casting machine shown in FIG. 1 is a cold-chamber vacuum die casting machine equipped with a moving mold section 1 and a stationary mold section 3. The two mold sections 1 and 3 are supported in the frame of the vacuum die casting machine in a conventional manner. An injection chamber 5 containing a plunger 7 extends into the stationary mold section 3. Injection casting material, such as molten aluminum, can be poured manually or automatically into a filling chamber 5 through an opening 9. The plunger 7 has a limit switch rod 11 mounted thereon that moves with the travel of the plunger. The limit switch rod 11 carries a cam 13 that actuates limit switches 15, 17, 19, to be described in more detail below.

The mold cavity 21, which can be filled with the molten injection casting material to be forced into the filling chamber 5 when the plunger 7 is moved, is defined in a conventional manner between the moving mold section 1 and the stationary mold section 3. The mold cavity 21 communicates with a vacuum insert 25 through a channel 23 that in turn can be connected to a vacuum tank 29 through a valve 27. The vacuum tank 29 is depressurized or evacuated by means of a so-called locking gate pump 31 or the like. A pressure gauge 33 is placed preferably in the line between the valve 29 and the vacuum tank 29. The vacuum tank 29 is also provided with a pressure gauge 35.

A valve rod 37 (FIG. 2) with a valve head 39 extends into the vacuum insert 25. The valve rod 37 is adapted for sliding movement in a sealed bore of the vacuum insert 25 so that the valve head 39 can open and close communication between the vacuum channel 23 and the exhaust channel 41. In other words, the valve head 39 opens and closes the exhaust channel. The left-hand end or opposite end of the valve rod 37 extends into the actuating insert 43, which is removably mounted on the rearward side of the moving mold section 1.

Figure 2:
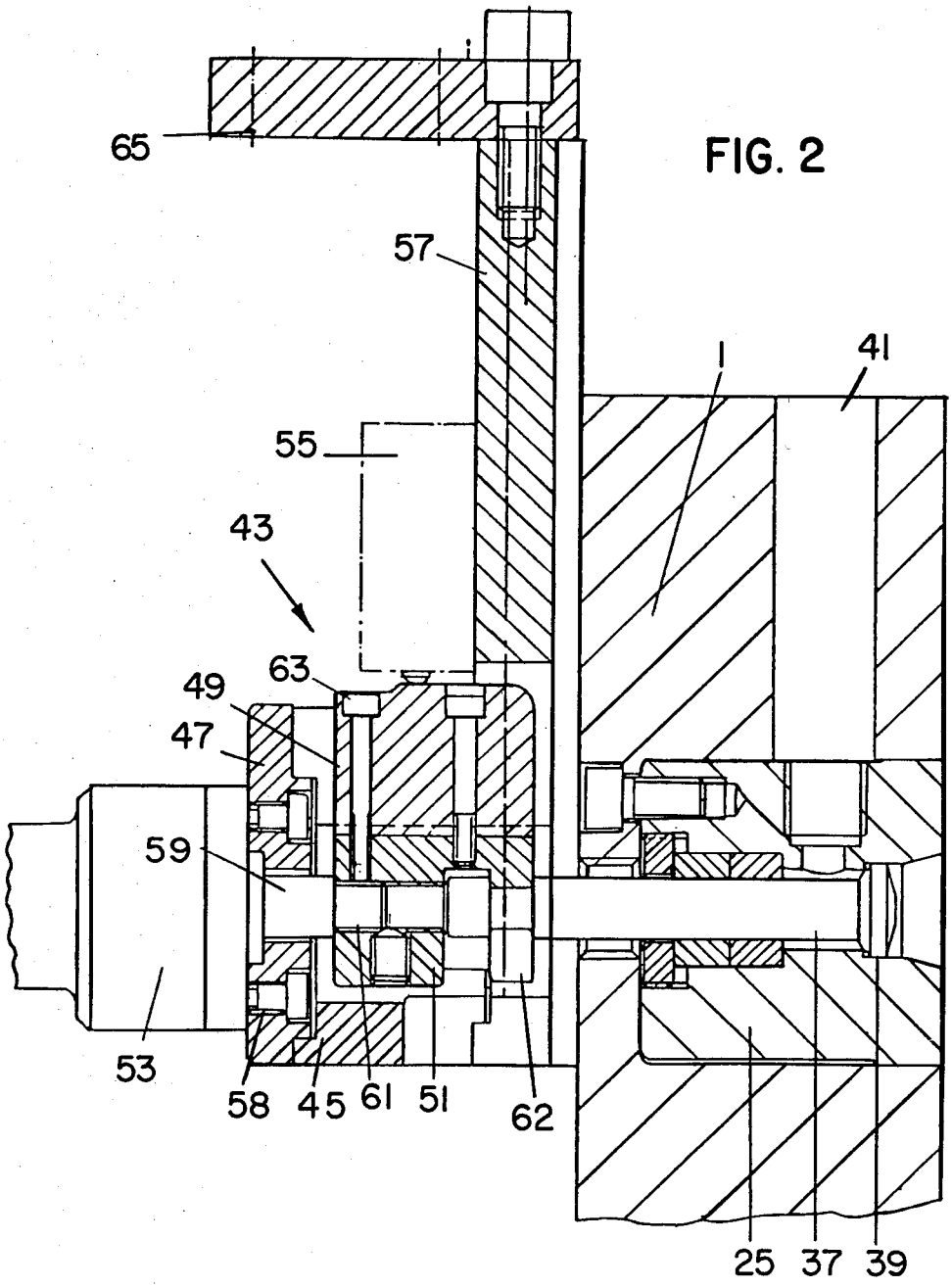
FIG. 2 is a sectional view on an enlarged scale, illustrating the actuating insert of FIG. 1 and showing its association with the vacuum insert containing the valve rod.
Figure 3:
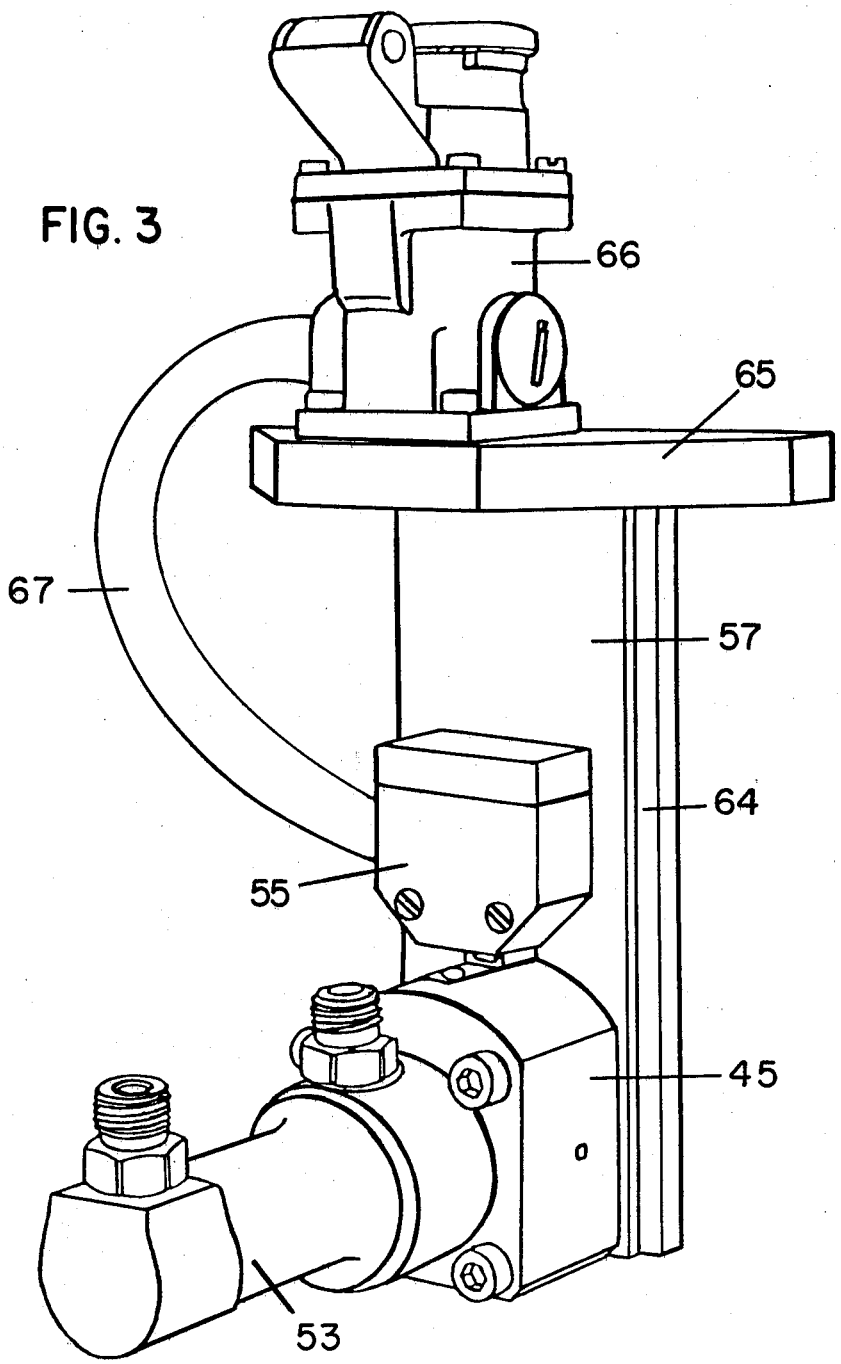
FIG. 3 is a perspective view of the actuating insert represented in FIG. 2, showing a socket that can be attached if required and that is connected to a limit switch.

The actuating insert 43 comprises a casing 45 with an intermediate flange, a trip cam 49, a coupling 51, an actuating cylinder 53, and a limit switch 55 (FIG. 3). The casting 45 is fastened to a build-up plate 57 by means, for example, of screws, and the intermediate flange 47 is mounted on the casing 45 with means that also serve to secure the actuating cylinder 53. As shown in FIG. 2, the actuating cylinder is secured by screws 58.

The piston rod 59 of the fluid-operated actuating cylinder 53 is connected to the coupling 51 by a threaded portion 61. Connecting means, such as a pin or a screw, secure the threaded portion 61 in the corresponding counter-thread of the coupling 51. Accordingly, the coupling 51 reciprocates within the casting 45 in response to the actuation of the actuating cylinder 53. The coupling 51 is connected to the trip cam 49 by screws 63, so that the trip cam moves with the coupling 51. The contour of the camming surface of the trip cam is shown in FIG. 2, and it is adapted to actuate the tripping pin of the limit switch 55, schematically represented in FIG. 2.

The coupling 51 has a bifurcated element 62 that engages a groove at the left end of the control bolt 37, as shown in FIG. 2. This provides an operative connection between the coupling and the control bolt 37. The longitudinal movement of the actuating rod 59 causes corresponding movement of the control bolt 37 due to the coupling 51.

Guide channels (not shown) are provided on the rearward side of the moving mold section 1 to receive the build-up plate 57 and its associated components described above. For this purpose, the build-up plate 57 is provided with corresponding rails 64 (FIG. 3) along its longitudinal edges. A supporting plate is preferably secured to the build-up plate 57 from above after the build-up plate is inserted in the guide channels on the mold section 1. Accordingly, the supporting plate 65 is provided with corresponding tapped holes for screws that extend into the upper front face 57 and into respective bores of the guide channels. Thus, the supporting plate 65 determines the position of the actuating insert 43 relative to the moving mold section and to the control bolt 37 that extends out of the mold section 1 as shown in FIG. 2.

If the supporting plate 65 is released and subsequently the build-up plate 57 is pulled out of its guide channels in an upward direction, the bifurcated element 62 disengages from the groove in the control bolt 37 without any further disassembly. When the build-up plate 57 is inserted in the guide channels, it is important that the groove of the control bolt 37 remaining in the moving mold section 1 be aligned with the bifurcated element 62.

As illustrated in FIG. 3, the supporting plate 65 can be used for attaching a multipole socket 66 that is connected to the cam-operated switch 55 by means of a cable. It is also possible, however, to mount the socket 66 with additional sockets in a switch cabinet, using a quick-release-type plug-in connection so that the actuating insert 43 may be readily replaced by another insert.

Figure 4:
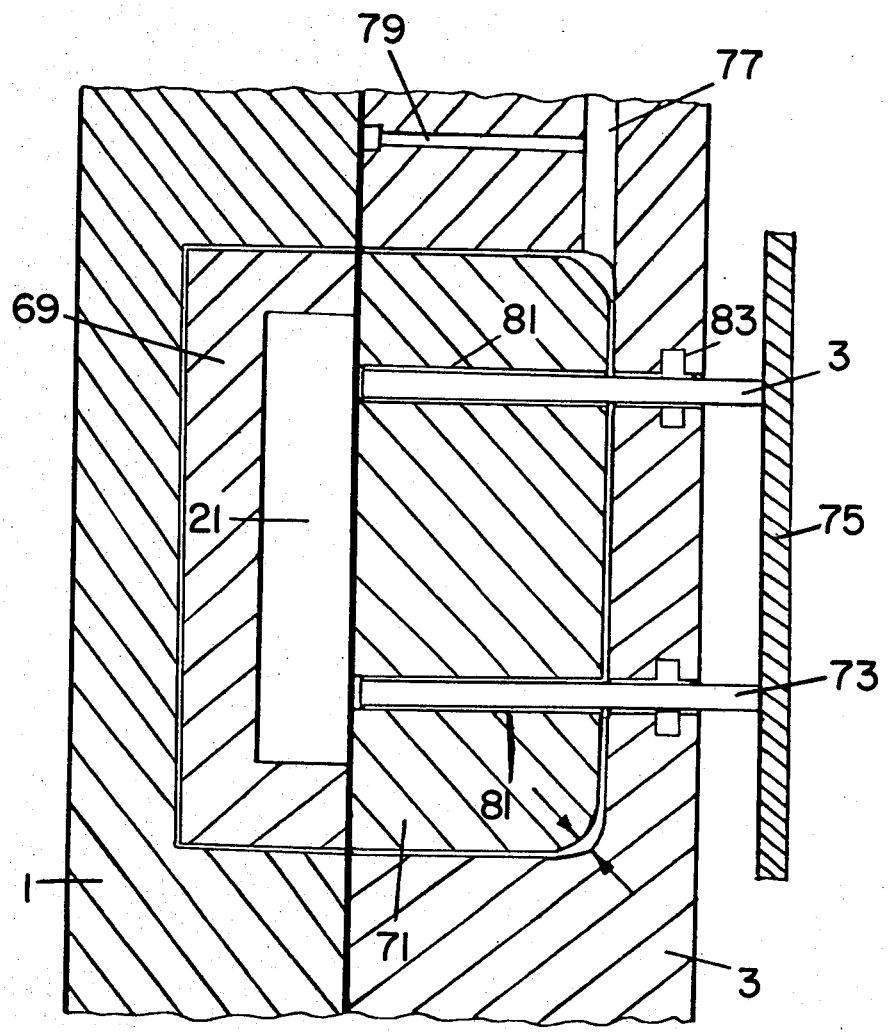
FIG. 4 is a diagrammatic view illustrating another aspect of the vacuum system for obtaining an improved evacuation of atmosphere through the space between the mold insert and the mold section that contains the mold insert.

As indicated above, it is important to obtain a thorough evacuation of the mold cavity. Generally, air can escape through the gap between the moving and stationary mold sections. Air can also escape through the annular gaps around the ejector pins, as is well known in the art. These annular gaps may have a thickness of between 0.01 and 0.05 mm between the individual ejector pins and the matching openings in the mold insert. In accordance with the invention, an improved evacuation of the mold cavity can be obtained by substantially reducing the leakage through the gaps, which are shown in FIG. 4. Two mold inserts 69 and 71 that are conventionally formed of expensive material, and which define the mold cavity between them, are inserted in the two mold sections 1 and 2, which are made of less expensive material. The ejector pins 73 extend through the mold insert 71, as shown in FIG. 4, and are connected to an ejector plate 75. They are used to eject the molded product from the mold cavity 21 after the molding process is complete, and after the mold sections 1 and 3 are separated.

According to another aspect of the invention, air is evacuated from the mold cavity through the gap between the mold insert 71 and the mold section 1. An exhaust channel 77 is provided for this purpose, the channel 77 being connected to a continuous or intermittently operated exhaust pump.

The exhaust channel 77 can be connected to the mold sections through one or more bores 79, and is connected to an annular space (FIG. 4) formed at the rearward side of the mold insert 71, due to the difference in radius between the mold insert and the mold section. The ejector bores 81 are connected to one another through collecting channels (not shown) located at the rearward side of the mold insert. Accordingly, the exhaust channel 77 is in a position to evacuate all annular gaps and interstices in the area of the ejector bores and between the mold insert and the mold section. Sealing elements 83 are preferably provided for the ejector pin 73 so that air cannot enter during the evacuation process.

No particular control is necessary for the above-mentioned evacuation process, since the exhaust channel 77 or a plurality of such channels can be connected to the existing exhaust system. It may be advantageous to operate the above-described exhaust process continuously or, in other words, to have a continuous connection to the vacuum pump. Consequently, air would be prevented from flowing into the mold cavity through the ejector bores during the evacuation of the mold, which would improve the vacuum. Furthermore, cooling liquid will not be sucked through the ejector bores or the annular gap between the mold section and the mold insert. The cooling liquid, particularly if it is oil, may cause a considerable rejection rate because oil could be embedded in the casting.

The operation of the above-described vacuum die casting machine in accordance with the invention is as follows:

At the beginning of the injection casting operation, the two mold sections 1 and 3 are closed by moving the movable mold section 1 toward the fixed mold section 3. Subsequently, injection casting material, e.g., molten aluminum, is poured automatically or by hand into the filling chamber 5. Then the plunger 7 extends into the filling chamber 5, thereby closing the opening 9. The limit switch rod 11, following the movement of the plunger 7, engages the limit switch 17 through the cam 13 represented in FIG. 1 by the expression "vacuum arm."

Following this, the valve 27, which preferably has a magnetic drive, opens and the vacuum tank 29 is evacuated by the locking gate pump 31. The vacuum tank is connected to the mold cavity 21 when the angular valve is actuated, and thus exhausts the air and remaining gases. The molten metal displaced by the plunger 7 reaches the gate 85 shown in FIG. 1 during the above-described phase. The valve rod 37 has its head 39 in the open position, i.e., in the right-hand position as shown in FIG. 2, during the exhaust process. Accordingly, an open passage is established between the channel 23 and the exhaust channel 41 to the vacuum tank 29.

At this point, the second or injection phase of the operation begins. During its movement to the left, the cam 13 actuates the limit switch 19 to actuate a pilot valve 87 shown in FIG. 1. The pilot valve releases fluid to the actuating cylinder 53 shown in FIG. 2, so that the actuating cylinder 53 moves the valve rod 37 to bring the valve head 39 to the closed position. As soon as the head 39 of the control bolt 37 has nearly reached the closed position, i.e., where the valve head 39 advances from the conical section shown in FIG. 2 into the cylindrical bore, a limit switch 55 located on the actuating insert causes a signal that initiates the injection stroke or "quick-shot." During this time, the valve rod 37 can complete its closing stroke. Thus, air will continue to be exhausted through the annular gap between the bore and the valve head 39 from the mold cavity. If the valve rod does not close completely during the remaining time (this may be due to failure of the hydraulic system or the electrical system), an electrical timer that was actuated simultaneously with the pilot valve 87 will stop the initial slow advance of the plunger and retract it back to its initial position as soon as a predetermined safety interval has elapsed. This safety interval may be, for example, 0.01 second. During the safety interval, the plunger advances relatively slowly. It may perhaps push some molten metal into the mold cavity; however, that metal cannot penetrate into the vacuum insert 25. In any event, the timer circuit prevents the actuation of the injection stroke or "quick-shot" when the valve rod is not in its final closed position. The timer, therefore, serves as a safety device.

The above-described system may also be operated without safety control, such as if the exhausting of air from the mold insert is also to be conducted during the injection process. For this purpose, a timer switch may cause a prolonging of the valve opening. The duration of the valve opening may be very great. In this case, the process is as follows.

The plunger 7 advances slowly and closes the opening 9. Then, the point is reached where the limit switch 19 sends out its signal to begin the injection stroke or "quick-shot." At this moment, the timer switch is triggered. At the same time, the injection stroke, or "quick-shot" valve, of the vacuum die casting machine opens and the plunger 7 initiates its injection stroke. The molten material flows into the mold and air is exhausted from the mold cavity—the timer switch keeping the injection stroke valve open another few milliseconds—whereas, molten metal flows into the cavity. The timer switch actuates a solenoid valve, which in turn closes the vacuum control valve, i.e., the valve rod 37 and valve with its valve head 39, at the proper moment through the hydraulic system. The latter-described system may be used, for example, in association with older vacuum die casting machines that do not permit very high plunger speeds or where the switching elements are so slow that the faster plunger speeds are achieved after considerable delay.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In a vacuum die casting machine including matching die assemblies relatively movable between open and closed positions and defining a die cavity when in their closed position, a plunger for injecting molten metal into said cavity and having a reciprocating cycle that includes an initial injection stroke, with a final molten metal injection movement and a retraction stroke, means associated with one of said die assemblies for evacuating atmosphere from said cavity during operation of said plunger and valve means in said one die assembly and movable linearly between open and closed positions for interrupting the evacuation of atmosphere from said cavity, the improvement which comprises:

fluid cylinder operated actuating means removably mounted on said one die assembly and having a piston adapted for linear travel, and in alignment with said valve means;

removably mounted coupling means operatively connecting said piston to said valve means;

electrically operated means for controlling said fluid cylinder means;

first electrical switch means operable by said plunger for actuating said means for controlling said fluid cylinder means for initiating closing movement of said valve means at a desired time during injection of molten metal;

timing means actuated by said plunger for initiating a predetermined time interval;

second electrical switch means operatively associated with said coupling means for initiating said final molten metal injection movement of said plunger when said valve means is closed; and third electrical switch means actuated by said timing means at the end of said time interval for actuating said electrically operated control means to cause retraction of said plunger in the event said valve means does not close completely to actuate said second electrical switch means before expiration of said time interval.

* * * * *